US011287233B2

(12) United States Patent
Zemany et al.

(10) Patent No.: US 11,287,233 B2
(45) Date of Patent: Mar. 29, 2022

(54) BALLISTIC RANGE ADJUSTMENT USING CONING COMMANDS

(71) Applicant: BAE Systems Information and Electronic Systems Integration Inc., Nashua, NH (US)

(72) Inventors: Paul D. Zemany, Amherst, NH (US); Matthew F. Chrobak, Groton, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 12 days.

(21) Appl. No.: 16/960,971

(22) PCT Filed: Aug. 30, 2019

(86) PCT No.: PCT/US2019/048984
§ 371 (c)(1),
(2) Date: Jul. 9, 2020

(87) PCT Pub. No.: WO2020/047367
PCT Pub. Date: Mar. 5, 2020

(65) Prior Publication Data

US 2020/0340787 A1 Oct. 29, 2020

Related U.S. Application Data

(60) Provisional application No. 62/725,609, filed on Aug. 31, 2018.

(51) Int. Cl.
*F42B 10/26* (2006.01)

(52) U.S. Cl.
CPC ..... *F42B 10/26* (2013.01)

(58) Field of Classification Search
CPC ..... F42B 10/02; F42B 10/00; F42B 10/14; F42B 10/34; F42B 10/38; F42B 10/42; F42B 10/46; B64C 39/00; G05D 1/101; G05D 1/108
See application file for complete search history.

(56) References Cited

U.S. PATENT DOCUMENTS

| | | | |
|---|---|---|---|
| RE32,094 | E | 3/1986 | Atanasoff et al. |
| 5,379,968 | A | 1/1995 | Grosso |
| 7,834,300 | B2 | 11/2010 | Zemany et al. |
| 9,086,258 | B1 | 7/2015 | Vasudevan et al. |

(Continued)

OTHER PUBLICATIONS

International Search Report, PCT/US2019/048984, dated Nov. 8, 2019, 11 pages.

*Primary Examiner* — J. Woodrow Eldred
(74) *Attorney, Agent, or Firm* — Scott J. Asmus; Sand, Sebolt & Wernow LPA

(57) ABSTRACT

A guided projectile including a precision guidance munition assembly utilizes angular rate sensors to sample a first angular velocity of the precision guidance munition assembly from the first angular rate sensor at a first time, sample a second angular velocity of the precision guidance munition assembly from the second angular rate sensor at the first time, generate a coning command based, at least in part, on the first angular velocity and the second angular velocity, and apply the coning command to the canard assembly. The range may be decreased or increased based on the coning commands.

19 Claims, 11 Drawing Sheets

(56) References Cited

U.S. PATENT DOCUMENTS

| | | | | |
|---|---|---|---|---|
| 9,587,923 | B2 | 3/2017 | Wurzel et al. | |
| 2011/0061456 | A1* | 3/2011 | Tyree | F41G 7/36<br>73/167 |

* cited by examiner

BALLISTIC RANGE ADJUSTMENT USING CONING COMMANDS

CROSS REFERENCE TO RELATED APPLICATIONS

This application claims the benefit of U.S. Provisional Application No. 62/725,609, filed Aug. 31, 2018, the content of which is incorporated by reference herein its entirety.

TECHNICAL FIELD

The present disclosure relates generally to guiding projectiles. More particularly, the present disclosure relates to adjusting range via coning commands. Specifically, the present disclosure relates to guiding a projectile based, at least in part, on sampling angular velocities and generating coning commands based, at least in part, on the angular velocities.

BACKGROUND

Guided projectiles are typically limited in how much they can maneuver. Typically, a significant source of impact error is range dispersion, which is the degree that the guided projectiles vary in range and deflection about a target. Often, canard control alone may not provide sufficient range correction capability for the guided projectiles. Therefore, other methods that provide additional or more range control are needed.

SUMMARY

Issues continue to exist with systems and methods for adjusting range using coning commands. The present disclosure provides a system and method to guide a projectile based, at least in part, on sampling angular velocities and generating coning commands based, at least in part, on the angular velocities. More particularly, the lift canard is used to either damp out or excite coning motion which changes the net drag and thus range of the guided projectile.

An example embodiment of the present disclosure provides a guided projectile including a precision guidance munition assembly; wherein the precision guidance munition assembly includes a front end and a rear end defining a longitudinal axis therebetween, wherein precision guidance munition assembly rotates about the longitudinal axis. A second axis can be defined being perpendicular to the longitudinal axis and a third axis can be defined as perpendicular to the longitudinal first axis and the second axis. The precision guidance munition assembly comprises a canard assembly including at least one canard that is moveable; wherein the at least one canard is pivotable about the second axis. Additionally, a first and second angular rate sensor can be carried by the precision guidance munition assembly to detect angular velocity of the precision guidance munition assembly about the second axis and third axis respectively. The precision guidance munition assembly contains at least one non-transitory computer-readable storage medium having instructions encoded thereon that when executed by at least one processor operates to aid in guidance, navigation and control of the guided projectile. Sample instructions may include: sample a first angular velocity of the precision guidance munition assembly from the first angular rate sensor at a first time, sample a second angular velocity of the precision guidance munition assembly from the second angular rate sensor at the first time, generate a coning command based, at least in part, on the first angular velocity and the second angular velocity, and apply the coning command to the canard assembly.

In one example, the precision guidance munition assembly may be oriented at any roll angle when the coning command is applied.

The precision guidance munition assembly may determine the coning motion of the guided projectile and apply a coning command. In one example, the coning command reduces the coning motion of the guided projectile. In another example, the coning command increases the coning motion of the guided projectile.

In one example, the at least one canard may include at least one lift canard. In this example, the at least one lift canard is pivotable about the second axis.

In one example, the first angular rate sensor and the second angular rate sensor are MEMS gyroscopes.

In one example, the instructions may further comprise producing a first value by multiplying the angular rate from the first angular rate sensor by $\cos(\theta)$; and producing a second value by multiplying the angular rate from the second angular rate sensor by $\sin(\theta)$. In one example, $\theta$ is approximately fifteen degrees. In another example, $\theta$ is approximately one hundred fifty-five degrees. The instructions may further include producing a third value by adding the first value to the second value and producing the coning command by multiplying the third value by a gain G. In one example, the absolute value of the coning command is limited to be approximately ten percent of a maximum canard deflection of the canard assembly. In one example, the gain is positive and, in another example, the gain is negative.

In one example, the instructions may further include limiting the coning command. In this example, the coning command may be limited to approximately ten percent of the maximum canard deflection of the canard assembly.

The instructions may further include generating a total command by adding the coning command to a steering command and applying the total command to the canard assembly.

In one example, the range of the guided projectile is controlled by adjusting or changing a coning amplitude of the guided projectile.

In one example, the range of the guided projectile is increased by decreasing the coning motion of the guided projectile.

In one example, the range of the guided projectile is decreased by increasing the coning motion of the guided projectile.

In another aspect, the present disclosure may provide a method comprising providing a guided projectile including a precision guidance munition assembly; wherein the precision guidance munition assembly includes a front end and a rear end defining a longitudinal axis therebetween, wherein precision guidance munition assembly rotates about the longitudinal axis. A second axis can be defined being perpendicular to the longitudinal axis and a third axis can be defined as perpendicular to the longitudinal first axis and the second axis. The precision guidance munition assembly comprises a canard assembly including at least one canard that is moveable; wherein the at least one canard is pivotable about the second axis. Additionally, a first angular rate sensor can be carried by the precision guidance munition assembly to detect angular velocity of the precision guidance munition assembly about the second axis; and a second angular rate sensor can be carried by the precision guidance munition assembly to detect angular velocity of the precision guidance munition assembly about the third axis. The method may further include sampling a first angular velocity of the precision guidance munition assembly from the first angular rate sensor at a first time, sampling a second angular velocity of the precision guidance munition assembly from the second angular rate sensor at the first time, and generating a coning command based, at least in part, on the first angular velocity and the second angular velocity, and applying the coning command to the canard assembly.

In one example, the precision guidance munition assembly may be oriented at any roll angle when the coning command is applied. In one example, the coning command may reduce the coning motion of the guided projectile, and, in another example, the coning command may increase the coning motion of the guided projectile.

In another aspect, the present disclosure may provide a guided projectile including a precision guidance munition assembly utilizes angular rate sensors to sample a first angular velocity of the precision guidance munition assembly from the first angular rate sensor at a first time, sample a second angular velocity of the precision guidance munition assembly from the second angular rate sensor at the first time, generate a coning command based, at least in part, on the first angular velocity and the second angular velocity, and apply the coning command to the canard assembly.

Implementations of the techniques discussed above may include a method or a process, a system or apparatus, a kit, or a computer software stored on a computer-accessible medium. The details or one or more implementations are set forth in the accompanying drawings and the description below. Other features will be apparent from the description, and from the claims.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the incentive subject matter.

BRIEF DESCRIPTION OF THE DRAWINGS

Sample embodiments of the present disclosure are set forth in the following description, is shown in the drawings and is particularly and distinctly pointed out and set forth in the appended claims.

Similar numbers refer to similar parts throughout the drawings.

DETAILED DESCRIPTION

Figure 1:
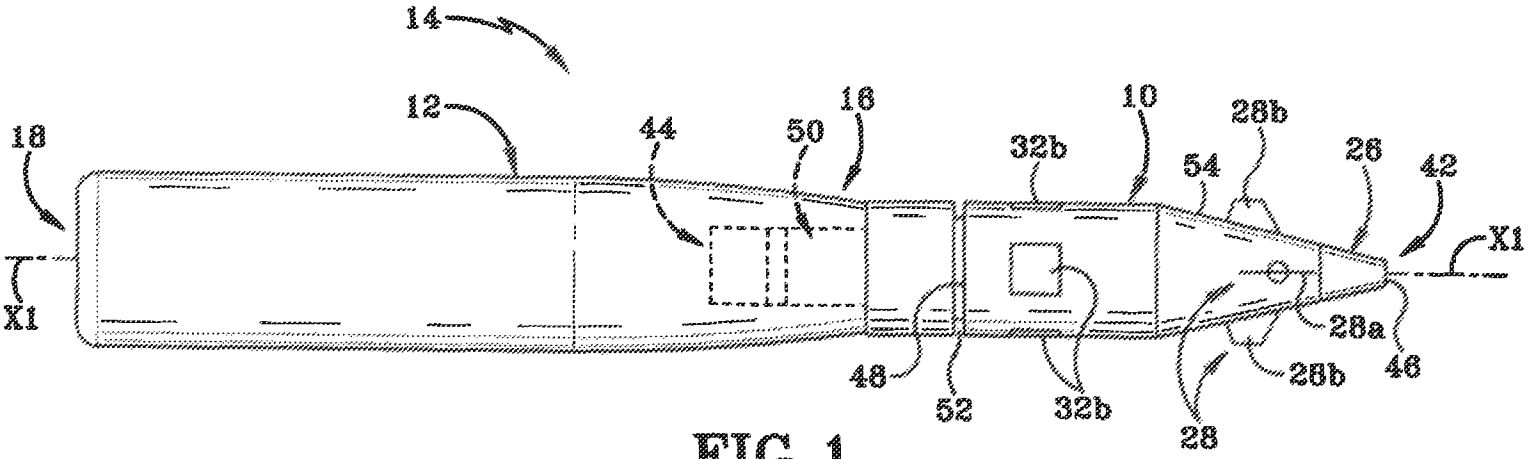
FIG. 1 is a schematic view of a guided projectile including a munition body and a precision guidance munition assembly in accordance with one aspect of the present disclosure.

A precision guidance munition assembly (PGMA) in accordance with the present disclosure is shown generally at 10. As shown in FIG. 1, the PGMA 10 is operatively coupled with a munition body 12, which may also be referred to as a projectile, to create a guided projectile 14. In one example, the PGMA 10 is connected to the munition body 12 via a threaded connection; however, the PGMA 10 may also be connected to the munition body 12 in any suitable manner. In one example, such as the APKWS precision guided munition kit, the precision guided munition assembly is coupled between the munition body 12 and the front end 42 which converts a projectile into a precision guided munition.

FIG. 1 depicts that the munition body 12 includes a front end 16 and an opposite tail or rear end 18 defining a longitudinal direction therebetween. The munition body 12 includes a first annular edge 20 (FIG. 1A), which, in one particular embodiment, is a leading edge on the munition body 12 such that the first annular edge 20 is a leading annular edge that is positioned at the front end 16 of the munition body 12. The munition body 12 in one example defines a cylindrical cavity 22 (FIG. 1A) extending rearward from the first annular edge 20 longitudinally centrally along a center of the munition body 12. The munition body 12 is formed from material, such as metal, that is structurally sufficient to carry an explosive charge configured to detonate or explode at, or near, a target. The munition body 12 may include tail flights (not shown) which help stabilize the munition body 12 during flight.

Figure 1A:
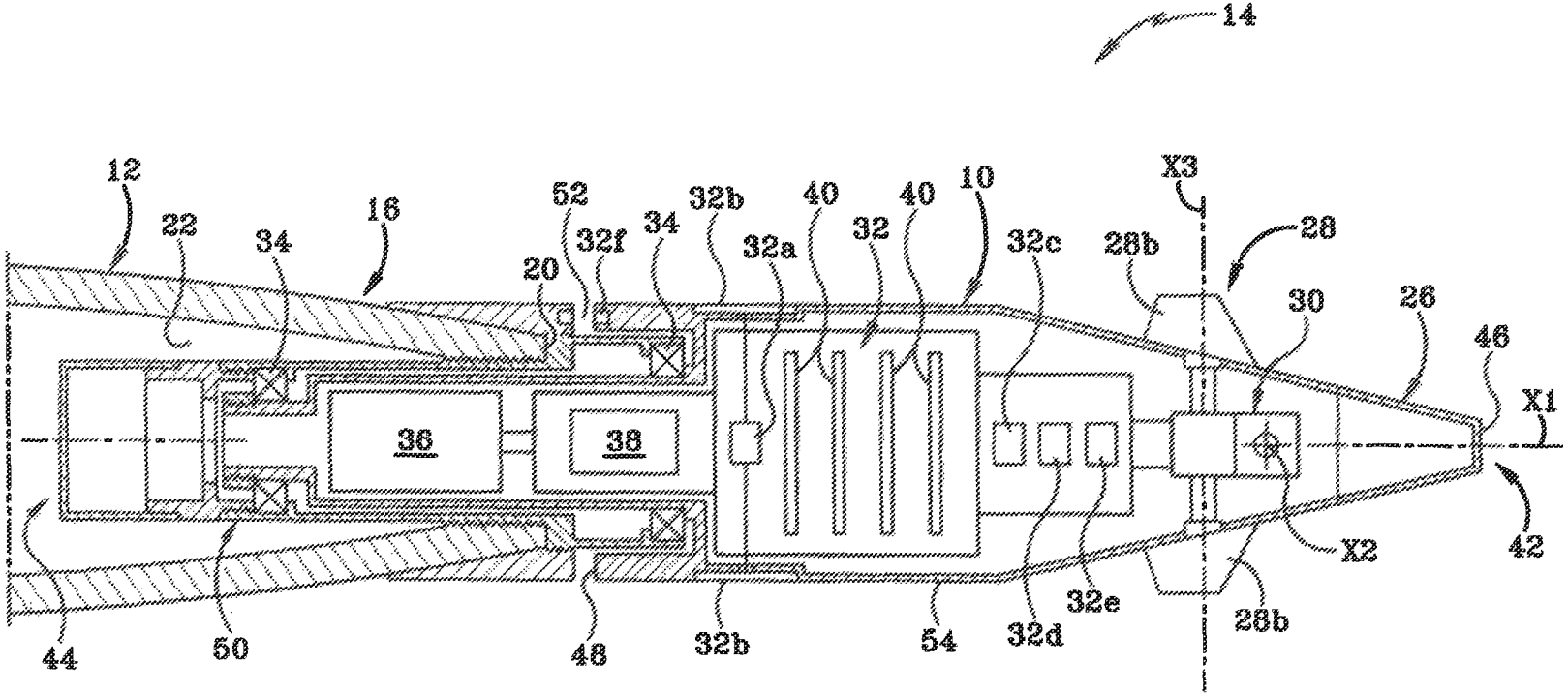
FIG. 1A is an enlarged fragmentary cross-section view of the guided projectile including the munition body and the precision guidance munition assembly in accordance with one aspect of the present disclosure.

FIG. 1A depicts that the PGMA 10, which may also be referred to as a despun assembly, includes, in one example, a fuze setter 26, a canard assembly 28 having one or more canards 28*a*, 28*b*, a control actuation system (CAS) 30, a guidance, navigation and control (GNC) section 32 having at least one guiding sensor 32*a*, such as a global positioning system (GPS), at least one GPS antenna 32*b*, a magnetometer 32*c*, a microelectromechanical systems (MEMS) gyroscope 32*d*, an MEMS accelerometer 32*e*, and a rotation sensor 32*f*, at least one bearing 34, a battery 36, at least one non-transitory computer-readable storage medium 38, and at least one processor or microprocessor 40.

Although the GNC section 32 has been described in FIG. 1A as having particular sensors, it should be noted that in other examples the GNC section 32 may include other sensors, including, but not limited to, laser guided sensors, electro-optical sensors, imaging sensors, inertial navigation systems (INSs), inertial measurement units (IMUs), or any other suitable sensors. In one example, the GNC section 32 may include an electro-optical and/or imaging sensor positioned on a forward portion of the PGMA 10. In another example, there are multiple sensors employed such that the guided projectile 14 can operate in a GPS-denied environment and for highly accurate targeting.

The at least one computer-readable storage medium 38 may include instructions encoded thereon that when executed by the at least one processor 40 carried by the PGMA 10 implements operations to aid in guidance, navigation and control (GNC) of the guided projectile 14.

The PGMA 10 includes a nose or front end 42 and an opposite tail or rear end 44. When the PGMA 10 is connected to the munition body 12, a longitudinal axis X1 extends centrally from the rear end 18 of the munition body to the front end 42 of the PGMA 10. FIG. 1A depicts one embodiment of the PGMA 10 as generally cone-shaped and defines the nose 42 of the PGMA 10. The one or more canards 28*a*, 28*b* of the canard assembly 28 are controlled via the CAS 30. The PGMA 10 further includes a forward tip 46 and a second annular edge 48. In one embodiment, the second annular edge 4θ is a trailing annular edge 48 positioned rearward from the tip 46. The second annular edge 4θ is oriented centrally around the longitudinal axis X1. The second annular edge 48 on the canard PGMA 10 is positioned forwardly from the first annular edge 20 on the munition body 12. The PGMA assembly 10 further includes a central cylindrical extension 50 that extends rearward and is received within the cylindrical cavity 22 via a threaded connection.

The second annular edge 4θ is shaped and sized complementary to the first annular edge 20. In one particular embodiment, a gap 52 is defined between the second annular edge 48 and the first annular edge 20. The gap 52 may be an annular gap surrounding the extension 50 that is void and free of any objects in the gap 52 so as to effectuate the free rotation of the PGMA 10 relative to the munition body 12.

Figure 2:
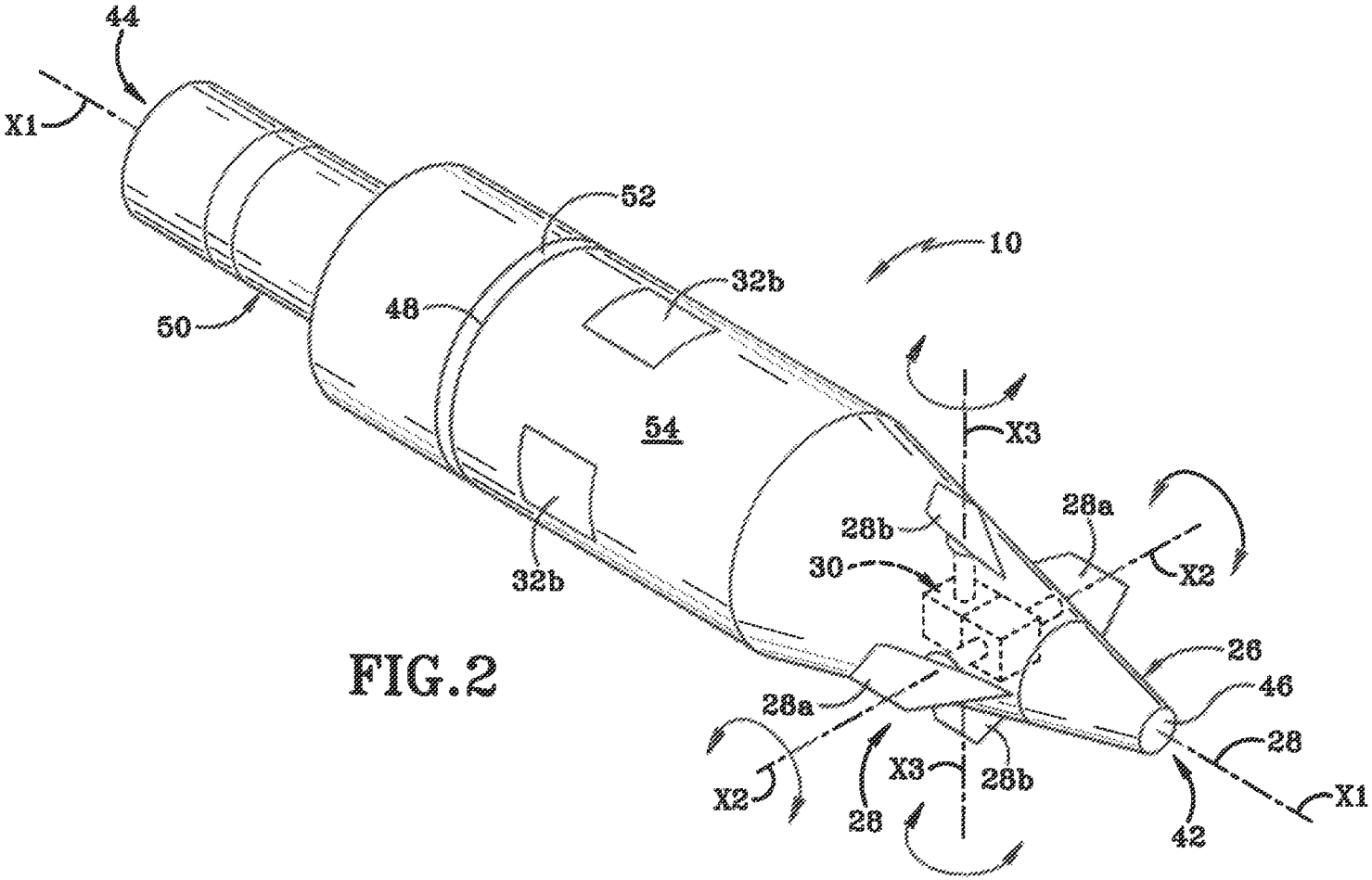
FIG. 2 is a schematic perspective view of precision guidance munition assembly.

FIG. 2 depicts an embodiment of the precision guidance munition assembly, wherein the PGMA 10 has at least one lift canard 28*a* extending radially outward from an exterior surface 54 relative to the longitudinal axis X1. The at least one lift canard 28*a* is pivotably connected to a portion of the PGMA 10 via the CAS 30 such that the lift canard 28*a* pivots relative to the exterior surface 54 of the PGMA 10 about a first pivot axis X2. In one particular embodiment, the first pivot axis X2 of the lift canard 28*a* intersects the longitudinal axis X1. In one particular embodiment, a second lift canard 28*a* is located diametrically opposite the at least one lift canard 28*a*, which could also be referred to as a first lift canard 28*a*. The second lift canard 28*a* is structurally similar to the first lift canard 28*a* such that it pivots about the first pivot axis X2. The PGMA 10 can control the pivoting movement of each lift canard 28*a* via the CAS 30. The first and second lift canards 28*a* cooperate to control the lift of the guided projectile 14 while it is in motion after being fired from a launch assembly 56 (FIG. 3).

The PGMA 10 may further include at least one roll canard 28*b* extending radially outward from the exterior surface 54 relative to the longitudinal axis X1. In one example, the at least one roll canard 28*b* is pivotably connected to a portion of the PGMA 10 via the CAS 30 such that the roll canard 28*b* pivots relative to the exterior surface 54 of the PGMA 10 about a second pivot axis X3. In one particular embodiment, the second pivot axis X3 of the roll canard 28*b* intersects the longitudinal axis X1. In one particular embodiment, a second roll canard 28*b* is located diametrically opposite the at least one roll canard 28*b*, which could also be referred to as a first roll canard 28*b*. The second roll canard 28*b* is structurally similar to the first roll canard 28*b* such that it pivots about the second pivot axis X3. The PGMA 10 can control the pivoting movement of each roll canard 28*b* via the CAS 30. The first and second roll canards 28*b* cooperate to control the roll of the guided projectile 14 while it is in motion after being fired from the launch assembly 56 (FIG. 3). While the launch assembly shows a ground asset launch, the launch assembly can also be launched by air-borne assets or maritime assets. In one example, the air-borne assets include helicopters, planes and drones.

Figure 3:
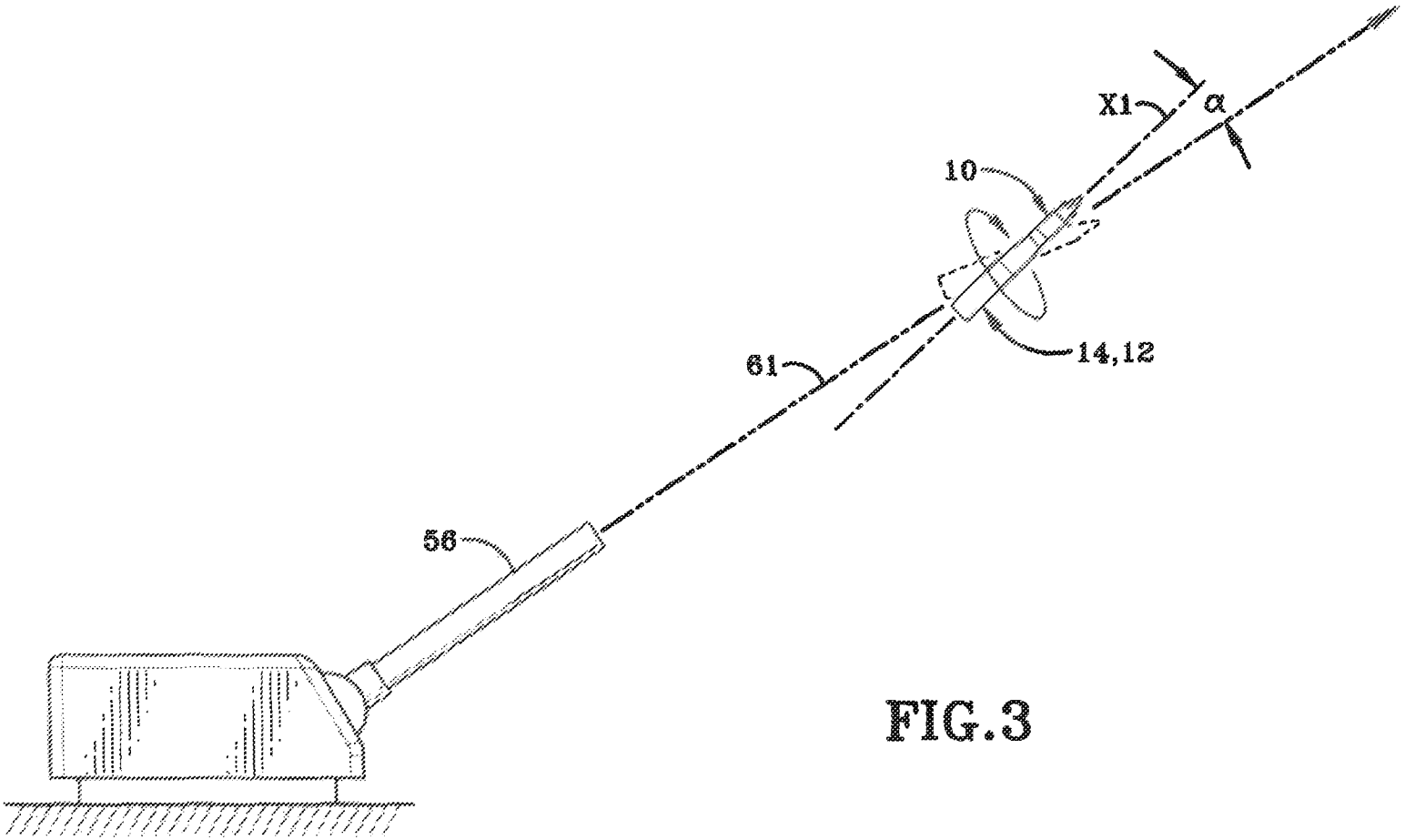
FIG. 3 is an operational schematic view of the guided projectile including the munition body and the precision guidance munition assembly fired from a launch assembly.

FIG. 3 depicts the operation of the PGMA 10 when it is coupled to the munition body 12 forming the guided projectile 14. As shown in FIG. 3, the guided projectile 14 is fired from the launch assembly 56 elevated at a quadrant elevation. As the guided projectile 14 travels along its flight path, the front end 42 of the PGMA 10 produces a coning motion that encircles a velocity vector 61 of the guided projectile 14. In one example, the coning motion is caused by gyroscopic precession of the guided projectile 14 where gyroscopic precession may be defined as the phenomenon in which the axis of a spinning object (e.g., the guided projectile 14) describes a cone in space when an external torque is applied to it. When the guided projectile 14 is viewed from the front, the direction of the coning motion is clockwise.

With continued reference to FIG. 3, an amplitude of the coning motion of the guided projectile 14 is represented by a coning angle $\alpha$, which may be defined as the angle between the longitudinal axis X1 of the guided projectile 14 and the velocity vector 61. The coning angle $\alpha$ and frequency of the coning motion may vary along the flight path of the guided projectile 14. A typical coning angle $\alpha$ may be approximately five degrees; however, the coning angle $\alpha$ may be other suitable coning angles. A typical coning motion frequency may be between approximately one-half (0.5) hertz (Hz) to five Hz; however, the coning motion frequency may be other suitable frequencies.

Figure 4:
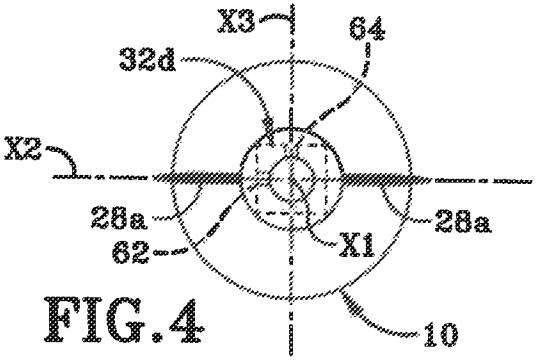
FIG. 4 is a front elevation view of one embodiment of the precision guidance munition assembly coupled to the munition body forming the guided projectile.

FIG. 4 is a front elevation view of one embodiment of the PGMA 10 coupled to the munition body forming the guided projectile 14. The PGMA 10 may rotate about the longitudinal axis X1, which, in this embodiment, is referred to as a longitudinal first axis X1. In this embodiment, the first pivot axis X2 is referred to as a second axis X2 and the second pivot axis X3 is referred to as a third axis. Therefore, in this embodiment, the lift canards 28*a* are pivotable about the second axis X2.

In one embodiment, the second axis X2 is perpendicular to the longitudinal first axis X1 and the third axis X3, and the third axis X3 is perpendicular to the longitudinal first axis X1 and the second axis X2. The PGMA 10 may rotate very little or not at all about the longitudinal axis X1, and, in this case, the PGMA 10 may be considered to be "despun" where the term despun refers to little to no rotation (less than ten rotations per second, i.e., ten Hz or less) about the longitudinal axis X1. If the PGMA 10 rotates, its rotation rate can be measured by a gyro, a compass or other sensor carried by the PGMA 10.

In one embodiment, the MEMS gyroscope 32*d* includes a plurality of gyroscopes for measuring the angular velocities of the PGMA 10. In this example, the MEMS gyroscope 32*d* may include a first angular rate sensor 62, which may also be referred to as a "q" gyro, and a second angular rate sensor 64, which may also be referred to as an "r" gyro, mounted such that the first angular rate sensor 62 and the second angular rate sensor 64 measure angular velocities that are orthogonal to one another when referenced relative to the PGMA 10. Although the MEMS gyroscope 32*d* has been described as including a first angular rate sensor 62 and a second angular rate sensor 64, it is to be understood that the MEMS gyroscope 32*d* may include other angular rate sensors.

In one embodiment, the q gyro 62, measures angular velocities of the PGMA 10 along the second axis X2 and the r gyro 64, measures angular velocities along the third axis X3. In one example the coning motion sensed by the q gyro is pitch movement and motion sensed by the r gyro is the yaw. Given the circular motion of the coning motion the signals from the q and r gyros have a quadrature relation, they are ninety degrees out of phase. The coning motion can be damped out or excited though movement of the lift canards.

As stated above, the at least one computer-readable storage medium 38 may include instructions encoded thereon that when executed by the at least one processor 40 carried by the PGMA 10 implements operations to aid in guidance, navigation and control of the guided projectile 14. The instructions may include generating coning commands to make changes to the coning motion of the guided projectile 14 as the guided projectile 14 travels along its trajectory.

Figure 5A:
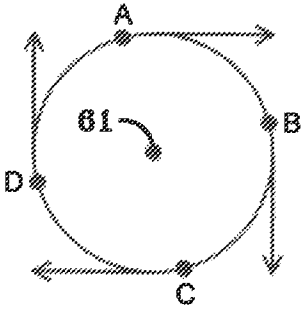
FIG. 5A is an exemplary coning motion of the guided projectile, when viewed from the front, including a velocity vector of the guided projectile.

FIG. 5A depicts an exemplary coning motion of the guided projectile 14, when viewed from the front, including the velocity vector 61 of the guided projectile 14. The nose 42 of the PGMA 10 moves in a clockwise circular motion from point A to point B to point C to point D with the arrows of FIG. 5A depicting the direction of travel of the nose 42 relative to the velocity vector 61 at each point A, B, C, and D.

Figure 5B:
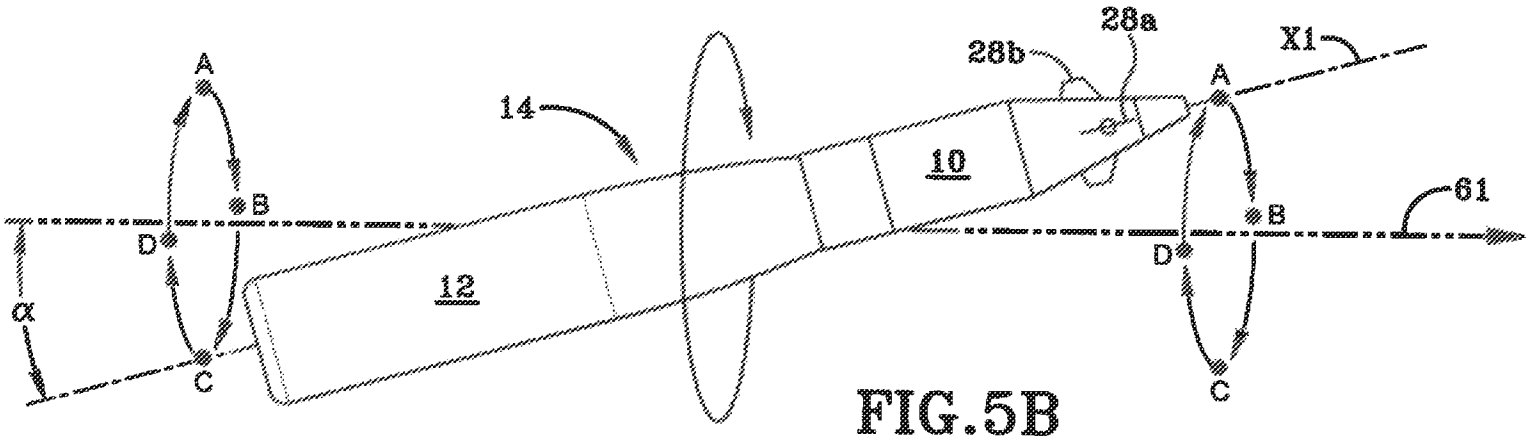
FIG. 5B depicts the coning motion of the guided projectile in flight along the velocity vector.

FIG. 5B depicts the coning motion of the guided projectile 14 in flight along the velocity vector 61. As shown in FIG. 5B, the nose 42 of the PGMA 10 is at point A, and moves in a clockwise circular motion from point A to point B to point C to point D with the arrows of FIG. 5B depicting the direction of travel of the nose 42 relative to the velocity vector 61 at each point A, B, C, and D.

In accordance with one aspect of the present disclosure, the coning commands can be used to damp out the coning motion of the guided projectile 14 or to excite the coning motion of the guided projectile 14 at various points along the fight path of the guided projectile 14. In one example, the coning command may be small compared to the maximum canard deflection of the PGMA 10. For example, and not meant as a limitation, the coning command may be approximately one degree which is about ten percent of the maximum canard deflection of the PGMA 10.

In one example, the coning command may be generated by sampling angular velocities of the PGMA 10 from the q gyro 62 and the r gyro 64 at certain times as the guided projectile 14 travels along its trajectory. For example, and not meant as a limitation, the angular velocities from the q gyro 62 and the r gyro 64 may be sampled every twenty milliseconds while the guided projectile 14 is in flight. Although the sampling rate has been described as being twenty milliseconds, the sampling rate may be any suitable sampling rate. Each sample from the q gyro 62 may be represented as q(t) where t represents the time that the sampling occurred and each sample from the r gyro 64 may be represented as r(t) where t represents the time that the sampling occurred.

Each sample from the q gyro, q(t), may be multiplied by A as shown in the following equation:

$$q(t)A \qquad \text{Equation (1)}$$

where A is equal to cos(θ) and θ defines the phase angle between the canard deflection and the coning motion of the guided projectile 14. In this example, θ is equal to fifteen degrees.

Each sample from the r gyro, r(t), may be multiplied by B as shown in the following equation:

$$r(t)B \qquad \text{Equation (2)}$$

where B is equal to sin(θ). In this example, θ is equal to fifteen degrees. In one example, setting θ to a value of fifteen degrees is optimal for reducing the coning motion based, at least in part, on the dynamics of the guided projectile 14. In another example, setting θ to a value of one hundred fifty-five degrees is optimal for increasing the coning motion based, at least in part, on the dynamics of the guided projectile 14. Although θ has been described as being fifteen and one hundred fifty-five degrees; θ may be any suitable value based on the dynamics of a particular projectile.

The instructions may add the values of Equation (1) and Equation (2) and multiply that value by gain, G as shown in the following equation:

$$G(qA+rB) \qquad \text{Equation (3)}$$

where Equation (3) provides the change in canard deflection. In one example, the value of G may be selected such that the results of Equation (3) are equal to or less than a threshold value. For example, and not meant as a limitation, G may be selected such that the results from Equation (3) are within approximately ten percent of the maximum canard deflection of the PGMA 10. The threshold value may be any suitable value.

For example, and not meant as a limitation, if the coning command is expressed in degrees, and the guided projectile 14 has a coning amplitude of three degrees, the canard motion would have a range between negative two degrees and two degrees. Further, if the guided projectile 14 has a coning amplitude of three degrees and a coning frequency of one Hz, the peak coning rate is approximately eighteen. Thus, in this example, a value of G of 2/18=0.11 may be used. In another example, the gain value, G, is set so that the maximum value of the coning command is limited to less than two degrees, but not to exceed ten percent of a maximum canard deflection of the PGMA 10. The sign of G may be positive or negative depending on the desired type of coning command. A positive value of G will damp out and reduce coning of the PGMA 10 while a negative value of G will excite or increase coning of the PGMA 10.

In one example, instructions are configured to produce a first value by multiplying the angular rate from the first angular rate sensor by cos(8); and producing a second value by multiplying the angular rate from the second angular rate sensor by sin(θ). In one example, θ is approximately fifteen degrees and another example, θ is approximately one hundred fifty-five degrees. The instructions further include producing a third value by adding the first value to the second value and producing the coning command by multiplying the third value by a gain G. In one example, the absolute value of the coning command is limited to be approximately ten percent of a maximum canard deflection of the canard assembly. In one example, the gain is positive and, in another example, the gain is negative The value from Equation (3) may be passed through a filter, such as a limiter, L, which limits the value to a certain value in accordance with the following equation:

$$G(qA+rB)(L) \qquad \text{Equation (4)}$$

where Equation (4) is a limited change in canard deflection. In one example, the limiter L may be set so that that the coning command is limited to less than two degrees or ten percent of a maximum canard deflection of the PGMA 10. Thus, for example, if the guided projectile 14 has a coning amplitude that is larger than three degrees or a coning frequency higher than one Hz, the Limiter would limit the coning command. Thus, a fixed gain of 0.11 can still be used.

The resulting coning command causes the lift canards 28*a* to oscillate at a coning frequency with a phase that causes the coning to damp out or with a phase that causes the coning to increase, depending on the desired outcome. In one example, the instructions may further include generating a total command by adding the coning command to a steering command and applying the total command to the canard assembly 28.

According to one embodiment, the projectile coning motion is sensed by the q (pitch) and r (yaw) gyros. Since the coning motion results in the projectile nose tracing a circle, the signals from the q and r gyros have a quadrature relation. That is, they are 90 degrees out of phase. The coning motion can either be damped out or excited using the steering canard by moving the steering canard at the coning frequency with the correct phase relative to the coning phase. The phase angle of the coning according to this example is:

$$\text{Theta_}c=\text{Coning_Phase}=\text{atan}(r(t),q(t)) \qquad \text{Equation (5)}$$

The phase of lift canard command is:

$$\text{Theta_}L=\text{Theta}+\text{Theta_}c \qquad \text{Equation (6)}$$

The value of theta in Equation 6 causes the resulting motion of the lift canard to either damp (or reduce) the coning motion or excite or increase the coning motion. The actual specific value of theta used to damp or excite coning depends on how the lift canard is oriented relative to the q and r reference frame. If for example the lift canard is in the pitch plain, then to damp coning the value of theta would be zero degrees and to excite coning the value of theta would be 90 degrees. In some examples the q and r gyro are installed at a non-zero angle relative to the lift canard. In these cases, the value of theta should take account of the installation angle.

Figure 6:
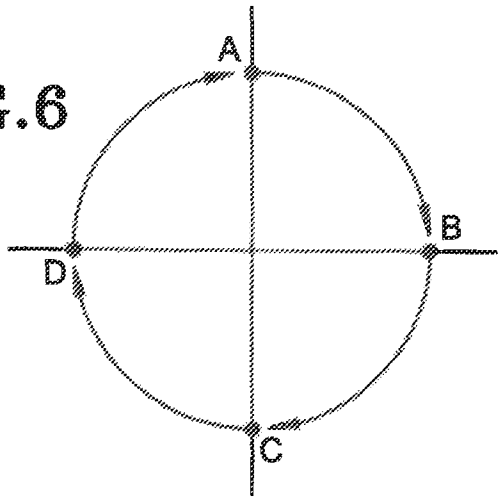
FIG. 6 depicts an exemplary coning motion of the precision guidance munition assembly if no coning command is applied to precision guidance munition assembly.

FIG. 6 depicts an exemplary coning motion of the PGMA 10 if no coning command is applied to the PGMA 10. As shown in FIG. 6, the nose 42 of the PGMA 10 moves in a clockwise circular motion from point A to point B to point C to point D.

Figure 7B:
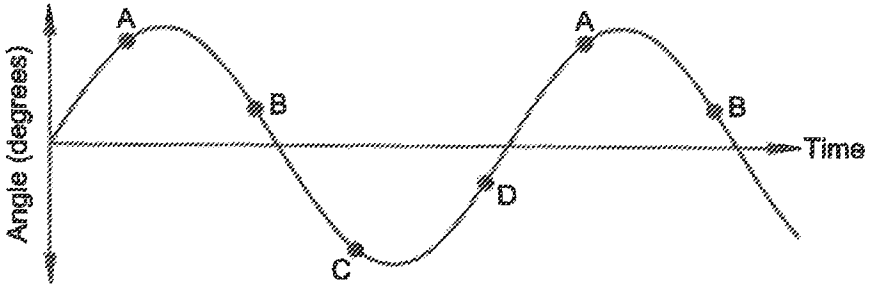
FIG. 7B is an exemplary plot of the coning command of FIG. 7A where the y axis is angle in degrees and the x axis is time in seconds.
Figure 7A:
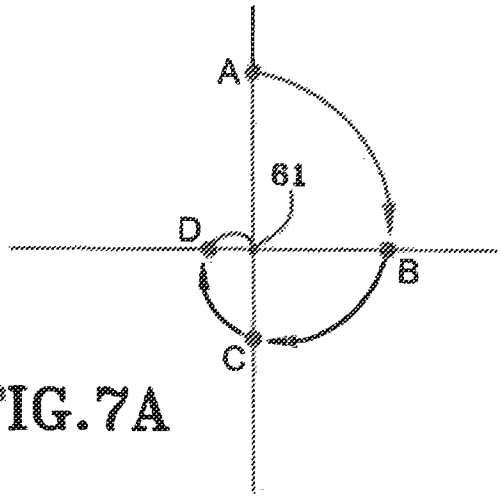
FIG. 7A depicts an exemplary coning motion of the precision guidance munition assembly, when viewed from the front, if a coning command is applied to decrease the coning motion.

FIG. 7A depicts an exemplary coning motion of the PGMA 10, when viewed from the front, if a coning command is applied to the PGMA 10 to decrease the coning motion of the PGMA 10. As shown in FIG. 7A, the nose 42 of the PGMA 10 moves in a clockwise circular motion from point A to point B to point C to point D to the velocity vector 61 of the guided projectile 14. Therefore, the coning motion of the guided projectile 14 decays and the coning angle α may be driven to zero degrees. FIG. 7B is a plot of the coning command where the y axis is angle in degrees and the x axis is time in seconds. As shown in FIG. 7B, the angle of the coning command is large and positive at point A, small and positive at point B, zero slightly after point B, large and negative at point C, and small and negative at point D before going through another cycle.

Figure 8B:
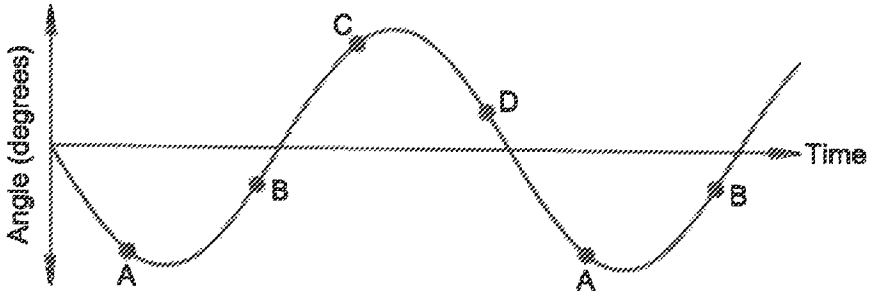
FIG. 8B is an exemplary plot of the coning command of FIG. 8A where the y axis is angle in degrees and the x axis is time in seconds.
Figure 8A:
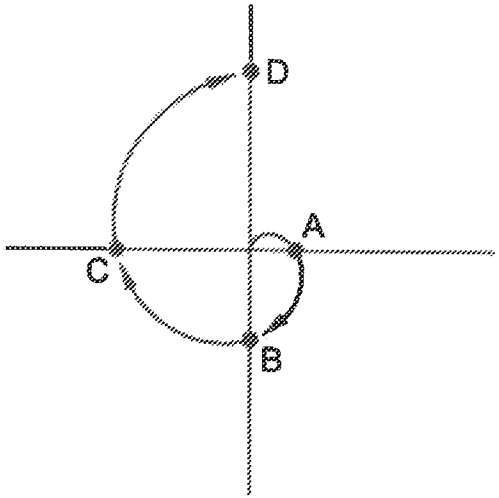
FIG. 8A depicts an exemplary coning motion of the precision guidance munition assembly, when viewed from the front, if a coning command is applied to increase the coning motion.

FIG. 8A depicts an exemplary coning motion of the PGMA 10, when viewed from the front, if a coning command is applied to the PGMA 10 to increase the coning motion of the PGMA 10. As shown in FIG. 8A, the nose 42 of the PGMA 10 moves in a clockwise circular motion from point A to point B to point C to point D and the nose 42 of the PGMA 10 moves out of alignment with the velocity vector 61 of the guided projectile 14. Therefore, the coning motion of the guided projectile 14 increases and the coning angle α may be driven away from zero degrees. FIG. 8B is a plot of the coning command where the y axis is angle in degrees and the x axis is time in seconds. As shown in FIG. 8B, the angle of the coning command is large and negative at point A, small and negative at point B, zero slightly after point B, large and positive at point C, and small and positive at point D before going through another cycle.

Figure 9A:
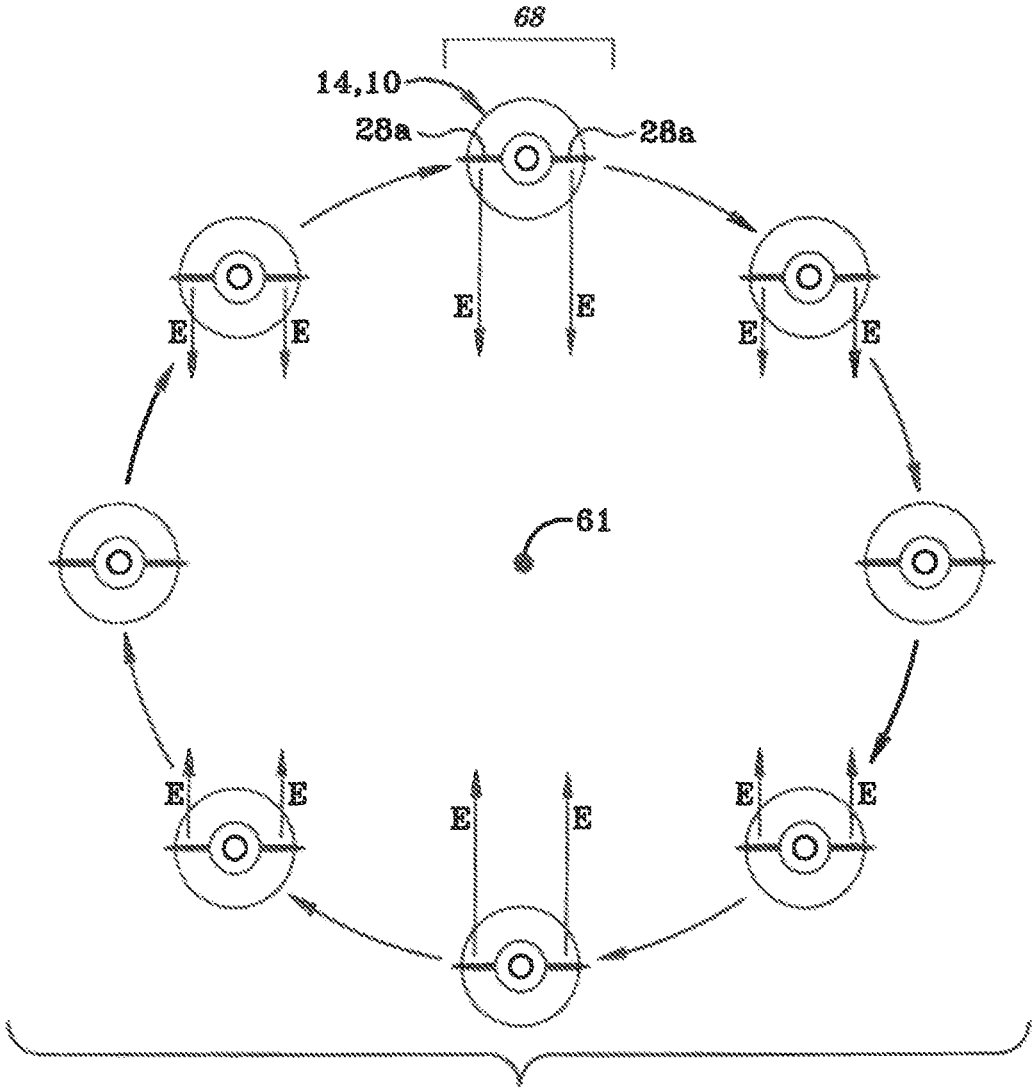
FIG. 9A depicts an the orientation of the precision guidance munition assembly at a zero degree roll angle, when viewed from the front, and the direction of the coning commands that act on the lift canards during the coning motion of the guided projectile.

It should be noted that the coning command may be generated regardless of the roll angle of the PGMA 10 since the q gyro 62 and the r gyro 64 measure angular velocities relative to the PGMA 10. Therefore, the coning commands that act on the lift canards 28*a* depend on the roll angle of the PGMA 10 relative to the coning motion as further described below. In one embodiment, FIG. 9A depicts an the orientation of the PGMA 10 at a zero degree roll angle, when viewed from the front and shown as 68, and the direction of the coning commands that act on the lift canards 28*a* during the coning motion of the guided projectile 14 are indicated by arrows denoted as E.

Figure 9B:
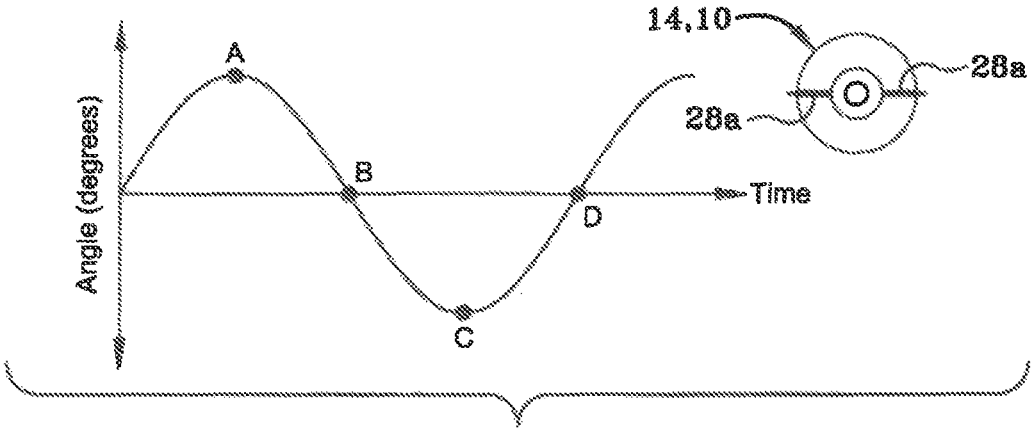
FIG. 9B is an exemplary plot of the coning command when the precision guidance kit is at a zero degree roll angle where the y axis is angle in degrees and the x axis is time in seconds.

FIG. 9B is a plot of the coning command when the PGMA 10 is at a zero degree roll angle, shown as 68, where the y axis is angle in degrees and the x axis is time in seconds. As shown in FIG. 9B, the angle of the coning command is large and positive at point A, zero at point B, large and negative at point C, and zero at point D before going through another cycle.

Figure 10A:
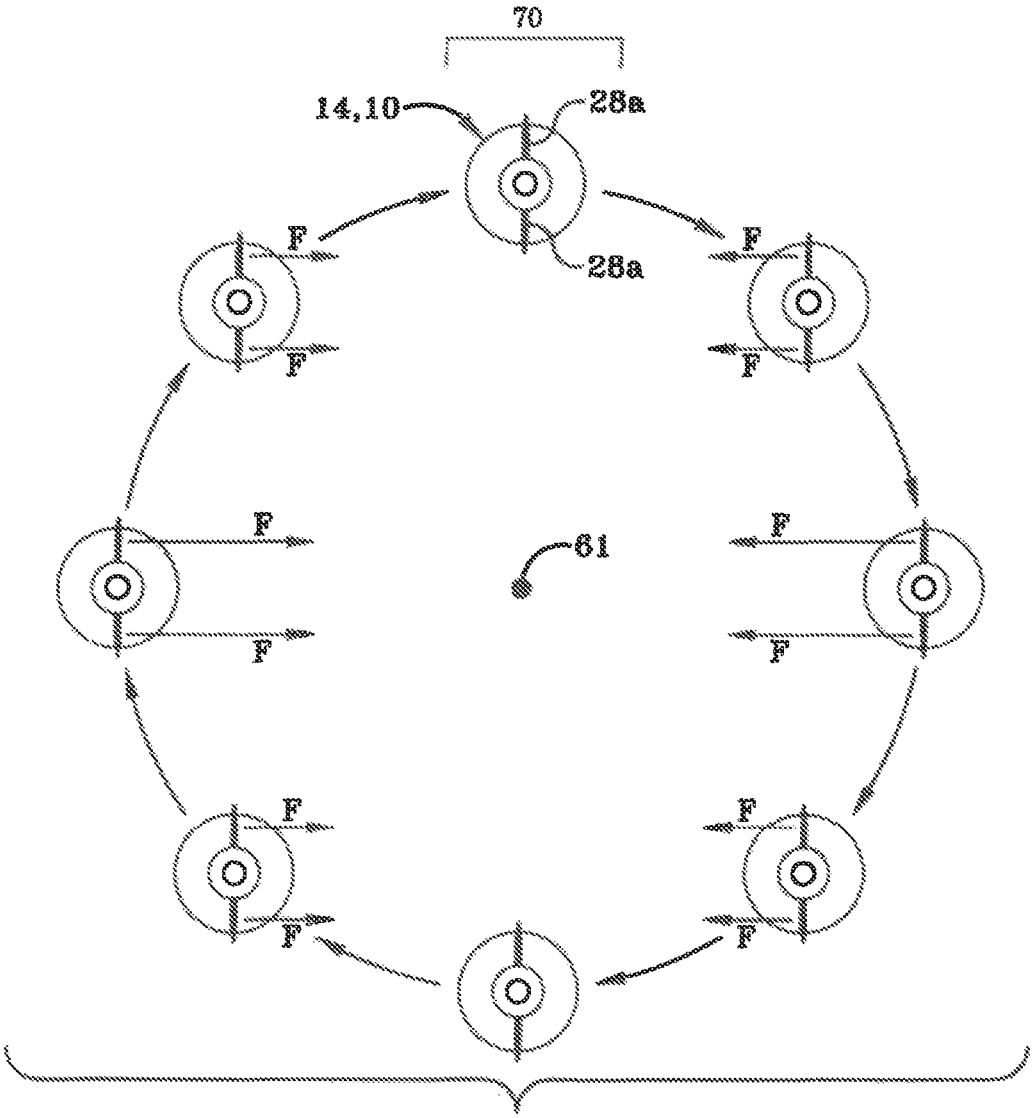
FIG. 10A depicts an the orientation the precision guidance munition assembly at a ninety degree roll angle, when viewed from the front, and the direction of the coning commands that act on the lift canards during the coning motion of the guided projectile.

In another example, and not meant to be limiting, FIG. 10A depicts an the orientation of the PGMA 10 at a ninety degree roll angle, when viewed from the front and shown as 70, and the direction of the coning commands that act on the lift canards 28*a* during the coning motion of the guided projectile 14 are indicated by arrows denoted as F.

Figure 10B:
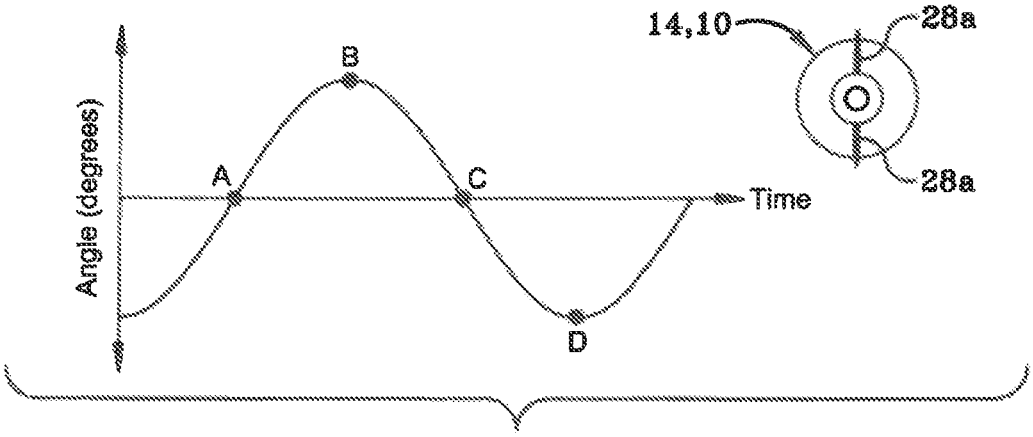
FIG. 10B is an exemplary plot of the coning command when the precision guided munition assembly is at a ninety degree roll angle where the y axis is angle in degrees and the x axis is time in seconds.

FIG. 10B is a plot of the coning command when the PGMA 10 is at a ninety degree roll angle where the y axis is angle in degrees and the x axis is time in seconds. As shown in FIG. 10B, the angle of the coning command is zero at point A, large and positive at point B, zero at point C and large and negative at point D before going through another cycle.

Thus, coning commands may be generated and applied to the lift canards 28*a* of the PGMA 10 regardless of the roll angle of the PGMA 10. As the roll angle changes, the direction that the coning commands act on the lift canards 28*a* change accordingly. It should be noted that the coning command may also be generated relative to the roll canards 28*b* and the teachings of the present disclosure may be applied in a similar manner when creating coning commands to act on the roll canards 28*b*.

In one example, the range of the guided projectile 14 is controlled by adjusting or changing a coning amplitude of the guided projectile 14.

In one example, the range of the guided projectile 14 is increased by decreasing the coning motion of the guided projectile 14.

In one example, the range of the guided projectile 14 is decreased by increasing the coning motion of the guided projectile 14.

Figure 11:
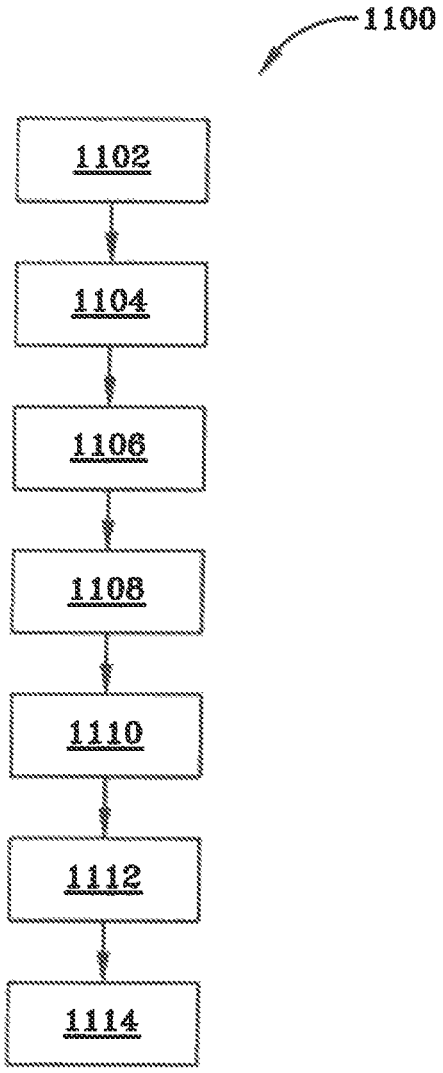
FIG. 11 is a flow chart of one method or process in accordance with the present disclosure.

FIG. 11 is a flow chart of one method or process in accordance with the present disclosure and is generally indicated at 1100. The method 1100 may include providing a guided projectile 14 including a precision guidance munition assembly 10; wherein the precision guidance munition assembly 10 includes a front end 42 and a rear end 44 defining a longitudinal first axis X1 extending therebetween; wherein the precision guidance munition assembly 10 rotates about the longitudinal first axis X1. A second axis X2 perpendicular to the longitudinal first axis X1, a third axis X3 perpendicular to the longitudinal first axis X1 and the second axis X2; a canard assembly 28 including at least one canard 28*a*, 28*b*, that is moveable; wherein the at least one canard 28*a*, 28*b*, is pivotable about the second axis X2. A first angular rate sensor 62 carried by the precision guidance munition assembly 10 to detect angular velocity of the precision guidance munition assembly 10 about the second axis X2; and a second angular rate sensor 64 carried by the precision guidance munition assembly 10 to detect angular velocity of the precision guidance munition assembly about the third axis X3, which is shown generally at 1102.

In further reference to FIG. 11 the method 1100 in this example includes sampling a first angular velocity of the precision guidance munition assembly 10 from the first angular rate sensor 62 at a first time, which is shown generally at 1104. The method 1100 includes sampling a second angular velocity of the precision guidance munition assembly 10 from the second angular rate sensor 64 at the first time, which is shown generally at 1106. The method includes generating a coning command based, at least in part, on the first angular velocity and the second angular velocity, which is shown generally at 1108. The method 100 includes applying the coning command to the canard assembly 28, which is shown generally at 1110. The method includes generating a total command by adding the coning command to a steering command, which is shown generally at 1112. The method 1100 in one example includes applying the total command to the canard assembly 28, which is shown generally at 1114. It should be noted that the reference to the first time is not intended to designate a specific time reference or otherwise limit the measurements to a single time period. In one example, time permitting, more than one sampling of the first and second angular velocity is processed.

Figure 12:
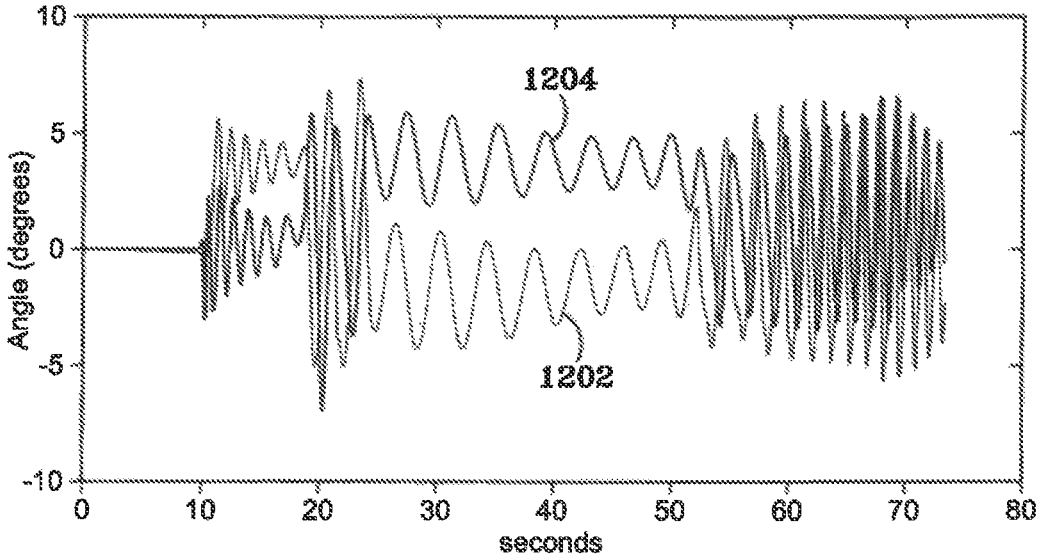
FIG. 12 is an exemplary graph showing coning oscillation of a guided projectile where the y axis is angle in degrees and the x axis is time in seconds.

FIG. 12 is an exemplary graph showing coning oscillation of a guided projectile 14 where the y axis is angle in degrees and the x axis is time in seconds. Line 1202 is an angle α and line 1204 is angle β. In this example, no coning command is applied to the guided projectile 14.

Figure 13:
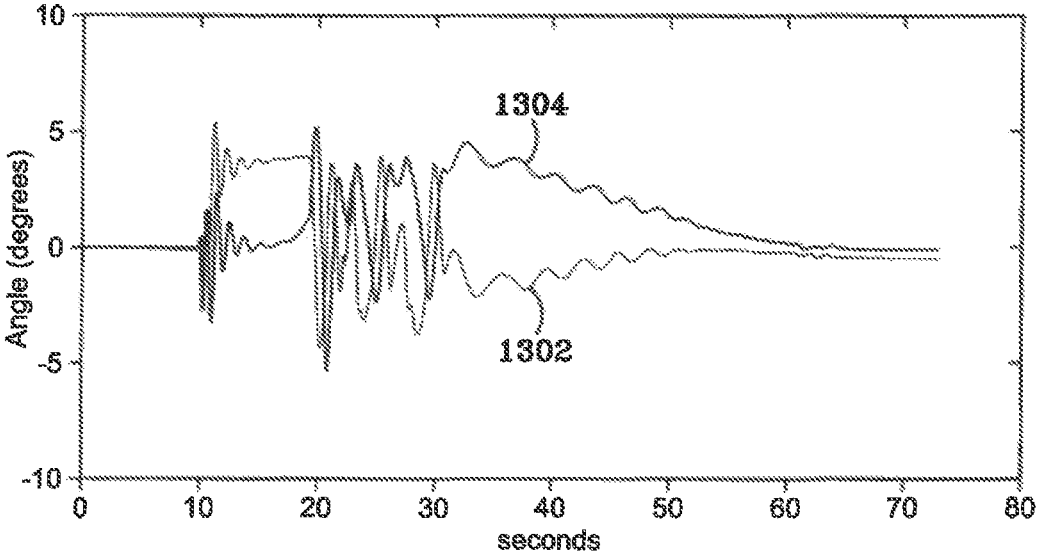
FIG. 13 is an exemplary graph showing coning oscillation of a guided projectile where the y axis is angle in degrees and the x axis is time in seconds.

FIG. 13 is an exemplary graph showing coning oscillation of a guided projectile 14 where the y axis is angle in degrees and the x axis is time in seconds. Line 1302 is an angle α and line 1304 is angle β. In this example, a coning command is applied to the guided projectile 14 to reduce the coning oscillation.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Guided projectile" or guided projectile 14 refers to any launched projectile such as rockets, mortars, missiles, cannon shells, shells, bullets and the like that are configured to have in-flight guidance.

"Launch Assembly" or launch assembly 56, as used herein, refers to rifle or rifled barrels, machine gun barrels, shotgun barrels, howitzer barrels, cannon barrels, naval gun barrels, mortar tubes, rocket launcher tubes, grenade launcher tubes, pistol barrels, revolver barrels, chokes for any of the aforementioned barrels, and tubes for similar weapons systems, or any other launching device that imparts a spin to a munition round or other round launched therefrom.

In some embodiments, the munition body 12 is a rocket that employs a precision guidance munition assembly 10 that is coupled to the rocket and thus becomes a guided projectile 14.

"Precision guided munition assembly," as used herein, should be understood to be a precision guidance kit, precision guidance system, a precision guidance kit system, or other name used for a guided projectile.

"Logic", as used herein, includes but is not limited to hardware, firmware, software and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The indefinite articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. A precision guidance munition assembly for a guided projectile, comprising:

a front end and a rear end defining a longitudinal axis therebetween; wherein the precision guidance munition assembly is configured to rotate about the longitudinal axis;

a second axis perpendicular to the longitudinal axis;

a third axis perpendicular to the longitudinal axis and the second axis;

a canard assembly including at least one canard coupled along the longitudinal axis; wherein the at least one canard is pivotable about the second axis;

a first angular rate sensor coupled to the precision guidance munition assembly to detect a first angular velocity of the precision guidance munition assembly about the second axis;

a second angular rate sensor coupled to the precision guidance munition assembly to detect a second angular velocity of the precision guidance munition assembly about the third axis; and at least one non-transitory computer-readable storage medium carried by the precision guidance munition assembly having a set of instructions encoded thereon that when executed by at least one processor operates to aid in guidance, navigation and control of the guided projectile, wherein the set of instructions perform the following:

sample a first angular velocity rate of the precision guidance munition assembly from the first angular rate sensor at a first time;

sample a second angular velocity rate of the precision guidance munition assembly from the second angular rate sensor at the first time;

generate a coning command based, at least in part, on the first angular velocity and the second angular velocity;

provide the coning command to the canard assembly;

produce a first value by multiplying the angular rate from the first angular rate sensor by cos(θ); and produce a second value by multiplying the angular rate from the second angular rate sensor by sin(θ).

2. The precision guidance munition assembly of claim 1, wherein the precision guidance munition assembly can be oriented at any roll angle when the coning command is applied.

3. The precision guidance munition assembly of claim 1, wherein the coning command reduces a coning motion of the guided projectile.

4. The precision guidance munition assembly of claim 1, wherein the coning command increases a coning motion of the guided projectile.

5. The precision guidance munition assembly of claim 1, wherein the at least one canard includes at least one lift canard; and wherein the at least one lift canard is pivotable about the second axis.

6. The precision guidance munition assembly of claim 1, wherein the first angular rate sensor and the second angular rate sensor are microelectromechanical systems (MEMS) gyroscopes.

7. The precision guidance munition assembly of claim 1, wherein θ is approximately fifteen degrees.

8. The precision guidance munition assembly of claim 1, wherein θ is approximately one hundred fifty-five degrees.

9. The precision guidance munition assembly of claim 1, wherein the set of instructions further comprise:

produce a third value by adding the first value to the second value; and produce the coning command by multiplying the third value by a gain, G.

10. The precision guidance munition assembly of claim 9, wherein an absolute value of the coning command is equal to or less than approximately ten percent of a maximum canard deflection of the canard assembly.

11. The precision guidance munition assembly of claim 9, wherein the gain is positive or negative.

12. The precision guidance munition assembly of claim 9, wherein the set of instructions further comprise:

limit the coning command.

13. The precision guidance munition assembly of claim 12, wherein the coning command is limited to approximately ten percent of the maximum canard deflection of the canard assembly.

14. The precision guidance munition assembly of claim 1, wherein the instructions further comprise:

generate a total command by adding the coning command to a steering command; and provide the total command to the canard assembly.

15. A method, comprising:

providing a precision guidance munition assembly for a guided projectile; wherein the precision guidance munition assembly comprises a front end and a rear end defining a longitudinal axis therebetween; wherein the precision guidance munition assembly rotates about the longitudinal axis; a second axis perpendicular to the longitudinal axis; a third axis perpendicular to the longitudinal axis and the second axis; a canard assembly including at least one canard coupled along the longitudinal axis; wherein the at least one canard is pivotable about the second axis; a first angular rate sensor to detect a first angular velocity of the precision guidance munition assembly about the second axis; and a second angular rate sensor to detect a second angular velocity of the precision guidance munition assembly about the third axis;

sampling a first angular velocity of the precision guidance munition assembly from the first angular rate sensor at a first time;

sampling a second angular velocity of the precision guidance munition assembly from the second angular rate sensor at the first time;

generating a coning command based, at least in part, on the first angular velocity and the second angular velocity;

applying the coning command to the canard assembly;

producing a first value by multiplying the angular rate from the first angular rate sensor by cos(θ); and producing a second value by multiplying the angular rate from the second angular rate sensor by sin(θ).

16. The method of claim 15, wherein the precision guidance munition assembly can be oriented at any roll angle when the coning command is applied.

17. The method of claim 15, wherein the coning command reduces a coning motion of the guided projectile.

18. The method of claim 15, wherein the coning command increases a coning motion of the guided projectile.

19. A computer program product including one or more non-transitory machine-readable mediums having instructions encoded thereon that, when executed by one or more processors, result in a plurality of operations for guiding a projectile, the operations comprising:

sampling a first angular velocity rate of the projectile from a first angular rate sensor at a first time;

sampling a second angular velocity rate of the projectile from a second angular rate sensor at the first time;

generate a coning command based, at least in part, on the first angular velocity and the second angular velocity;

providing the coning command to the canard assembly, wherein the coning command changes a coning motion of the projectile;

producing a first value by multiplying the angular rate from the first angular rate sensor by cos(θ);

producing a second value by multiplying the angular rate from the second angular rate sensor by sin(θ); and adjusting the coning command by the first value and the second value and providing the coning command to the canard assembly.

* * * * *